US010220403B2

(12) United States Patent
Orth

(10) Patent No.: US 10,220,403 B2
(45) Date of Patent: Mar. 5, 2019

(54) SPRINKLER PROTECTOR ASSEMBLY

(71) Applicant: Guillermo Orth, Lake Worth, FL (US)

(72) Inventor: Guillermo Orth, Lake Worth, FL (US)

( * ) Notice: Subject to any disclaimer, the term of this patent is extended or adjusted under 35 U.S.C. 154(b) by 0 days.

(21) Appl. No.: 15/656,351

(22) Filed: Jul. 21, 2017

(65) Prior Publication Data

US 2017/0320086 A1 Nov. 9, 2017

Related U.S. Application Data

(63) Continuation-in-part of application No. 14/868,836, filed on Sep. 29, 2015.

(60) Provisional application No. 62/062,514, filed on Oct. 10, 2014.

(51) Int. Cl.
*B05B 15/16* (2018.01)

(52) U.S. Cl.
CPC ..... *B05B 15/16* (2018.02)

(58) Field of Classification Search
CPC . B05B 15/001; B05B 15/16; Y10T 137/6995; Y10T 137/6991
USPC ..... 239/288, 288.3, 288.5; 137/364, 360, 137/361, 365; 220/484
See application file for complete search history.

(56) References Cited

U.S. PATENT DOCUMENTS 2,697,535 A * 12/1954 Olson ..... H02G 3/085 220/3.2
3,662,956 A * 5/1972 Hedman ..... B05B 15/001 239/201
4,763,837 A * 8/1988 Livneh ..... A01G 25/16 137/505.13
6,666,349 B1 * 12/2003 Gavin ..... E03F 5/021 220/484
2008/0302883 A1 12/2008 Gunderson et al.

* cited by examiner

*Primary Examiner* — Steven J Ganey
*Assistant Examiner* — Tuongminh N Pham

(57) ABSTRACT

A sprinkler assembly protector including a receptacle for receiving a sprinkler assembly and a lid for covering the receptacle. The receptacle includes a base and at least one sidewall together defining an internal space. The sidewall has sidewall punchouts for making small openings in the sidewalls, and concentric tearing-facilitating sections for enlarging the openings to allow a water supply line to pass through the sidewalls into the internal space. The lid has a lid opening for allowing the sprinkler assembly to pass through. The lid can be formed with tearing-facilitating sections to facilitate enlarging the lid opening. Drainage holes can be formed on the base and/or a bottom portion of the sidewall to prevent water from accumulating inside the receptacle.

3 Claims, 8 Drawing Sheets

SPRINKLER PROTECTOR ASSEMBLY

CROSS-REFERENCE TO RELATED APPLICATION

This application is a continuation of co-pending U.S. Utility patent application Ser. No. 14/868,836 filed Sep. 29, 2015, which claims the benefit of U.S. Provisional Patent Application Ser. No. 62/062,514, filed Oct. 10, 2014, both of which are incorporated herein by reference in their entirety.

FIELD OF THE INVENTION

The present invention relates generally to irrigation devices, and more particularly, to a device that can protect a sprinkler assembly so as to improve the function and durability of the sprinkler.

BACKGROUND OF THE INVENTION

Irrigation refers to the artificial application of water to the land or soil to assist in the growing of agriculture crops and the maintenance of landscapes during periods of inadequate rainfall. One common type of irrigation system is the lawn sprinkler system which has widespread use in maintaining lawns at individual homes or large commercial properties. A lawn sprinkler system is a system of sprinklers, usually installed below ground level, to scatter or spray water droplets over a lawn, golf course, or the like, similarly to a light rainfall.

A lawn sprinkler system needs regular maintenance for it to work properly over time. One of the most common problems that cause a lawn sprinkler system to malfunction is the damage to the sprinkler assemblies, which are often broken by lawnmower blades and snow shovels or which simply deteriorate due to the harsh environment. Constant contact with dirt, being soaked in water, being disrupted by grass roots, and constant exposure to hot or cold weather condition all could cause damage to the sprinkler assemblies. Water supply lines and joints are also subject to being damaged. For example, a supply line may be damaged between sprinkler assemblies and require replacement, a joint from the supply to the sprinkler assembly may break, or the supply may clog near the joint, etc. Broken sprinkler assemblies not only cause the sprinkler system to not work properly, but also cause water leaks which lead to a larger utility bill.

For many homeowners, it is a constant battle to have to locate broken sprinklers or supply lines and repair or replace them with new ones on a regular basis in order to keep a lawn sprinkler system working properly. Although the homeowners can hire professionals to care for their lawn sprinkler systems, professional services can prove to be expensive, which would add additional strain to the already tight budget of many homeowners.

In order to provide protection to sprinkler assemblies, certain sprinkler assembly protection devices have been developed. For example, relatively rigid sprinkler donuts or sprinkler crowns can be installed around sprinkler heads to protect the sprinkler from the lawnmowers and keep the grass away. However, the existing sprinkler assembly protection devices are generally designed to protect above ground sprinkler heads or pop-up sprinkler risers from bending or breaking. The underground portion of a sprinkler assembly including its supply is not protected by the existing sprinkler protection devices.

Accordingly, there is an established need for a convenient and money-saving sprinkler assembly protection device that can protect an underground sprinkler assembly and supply, or the underground portion of a sprinkler assembly in general, from being damaged by growing roots, harsh environment and weather conditions, accidental damage due to digging, and the like.

SUMMARY

The present invention is directed to a convenient and money-saving sprinkler assembly protector that is easy to install and provides protection to a buried or partially buried sprinkler assembly and its supply by preventing dirt from entering the sprinkler assembly and preventing root damage to the sprinkler assembly. The sprinkler assembly protector includes a receptacle for receiving a splinkler assembly therein and lid for covering the receptacle.

The receptacle can have any shape, such as cylindrical, frustoconical, rectangular, square, polygonal, tapered, straight, etc. The receptacle can include a base, at least one sidewall, and a top. The sidewall can include sidewall openings for the sprinkler assembly supply line and sprinkler assembly to pass through. In addition, the sidewall can include tearing-facilitating sections (such as perforated lines, or thinner-walled lines) to facilitate enlarging the sidewall openings and adjusting the sprinkler assembly protector to fit onto sprinkler assemblies and supplies having different sizes. The tearing-facilitating sections can be, for example, in the shape of concentric rings, which in turn are concentric to the base opening, and/or tearing facilitating lines extending radially from the center of the opening. The receptacle can also include drainage holes for draining water that may accumulate inside the receptacle. Drainage holes can be formed on the base and/or at the bottom portion of the sidewall.

Similarly to the receptacle, the lid includes a lid opening to allow the sprinkler assembly to pass through. The lid can include tearing-facilitating sections (such as perforated lines, or thinner-walled lines) to facilitate enlarging the lid opening and adjusting the sprinkler assembly protector to fit onto sprinkler assemblies having different sizes. The tearing facilitating sections can be, for example, in the shape of concentric rings, which in turn are concentric to the lid opening, or tearing-facilitating lines extending radially on the lid.

In an embodiment, a sprinkler assembly protector comprises a receptacle for receiving a sprinkler assembly and supply line therein, the receptacle including a base, one or more sidewalls, and an internal space formed by the base and the sidewall. The sidewall has sidewall openings for allowing the sprinkler supply line to pass through and extend into the internal space. A lid covers the receptacle, the lid having a lid opening for allowing the sprinkler assembly to pass through.

In another aspect the receptacle may have a cylindrical, frustoconical, rectangular, square, polygonal, tapered, or straight shape.

In another aspect, the sidewall may comprise tearing-facilitating sections to facilitate enlarging the sidewall openings.

In another aspect, the tearing-facilitating sections on the sidewalls may be formed by perforated lines or thinner-walled lines.

In another aspect, the tearing-facilitating sections on the sidewall may be in the shape of concentric rings.

In another aspect, the tearing-facilitating sections on the sidewall are tearing-facilitating lines extending radially on the base.

In another aspect, a plurality of user-selectable tearing-facilitating sections may be provided at different distances from the lid, and/or at different angles from a central axis of the receptacle, to permit supply inflow and outflow lines at various depths and directions to be accommodated.

In another aspect, the receptacle comprises drainage holes formed on the base and/or at a bottom portion of the sidewall.

In another aspect, the lid comprises tearing-facilitating sections to facilitate enlarging the lid opening.

In another aspect, the tearing-facilitating sections on the lid may be perforated lines or thinner-walled lines.

In another aspect, the tearing-facilitating sections on the lid are in the shape of concentric rings, which in turn are concentric to the lid opening.

In another aspect, the tearing-facilitating sections on the lid may be tearing-facilitating lines extending radially on the lid.

In another aspect, the lid and the receptacle may be made of lightweight plastic materials.

In another aspect, the sprinkler assembly protector may be configured to leave a gap or clearance between a sprinkler assembly and the receptacle sidewalls once the sprinkler assembly protector is fitted onto the sprinkler assembly.

In another aspect, the base can be formed with a raised central portion to direct water to drainage holes near the periphery of the base.

In another aspect, the sidewall can be provided with reinforcing ribs. The ribs may extend upward from the bottom of the sidewall.

These and other objects, features, and advantages of the present invention will become more readily apparent from the attached drawings and the detailed description of the preferred embodiments which follow.

BRIEF DESCRIPTION OF THE DRAWINGS

Embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature tmd is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations disclosed herein are by way of example only. They are provided to enable persons skilled in the art to make and use the embodiments described and are not intended to limit the scope of the invention, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary, or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the illustrated embodiments are directed toward convenient and economical sprinkler assembly protectors capable of protecting a buried or partially buried sprinkler assembly by preventing dirt from entering the sprinkler assembly, preventing root damage to the sprinkler assembly, and protecting the sprinkler assembly from harsh weather conditions.

Figure 1:
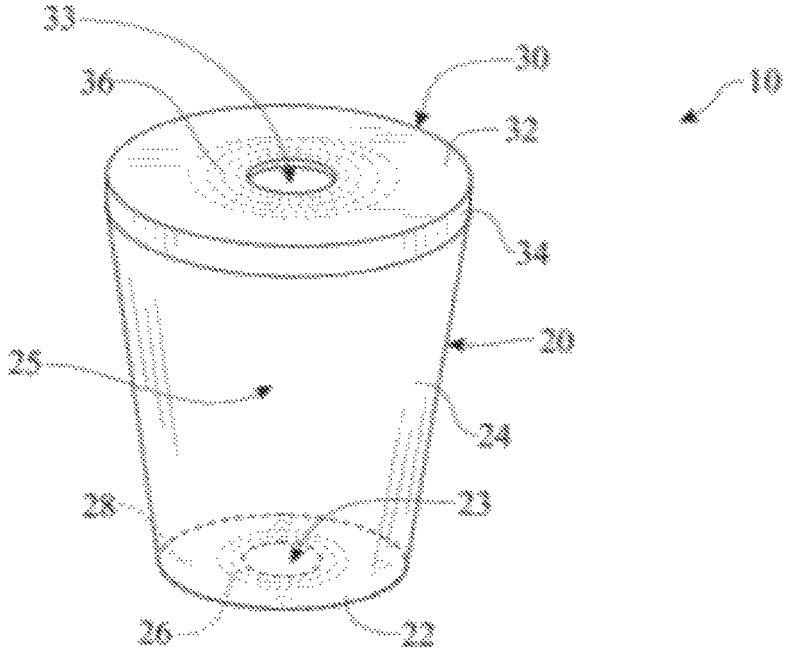
FIG. 1 presents an isometric view of an exemplary sprinkler assembly protector embodiment.
Figure 2:
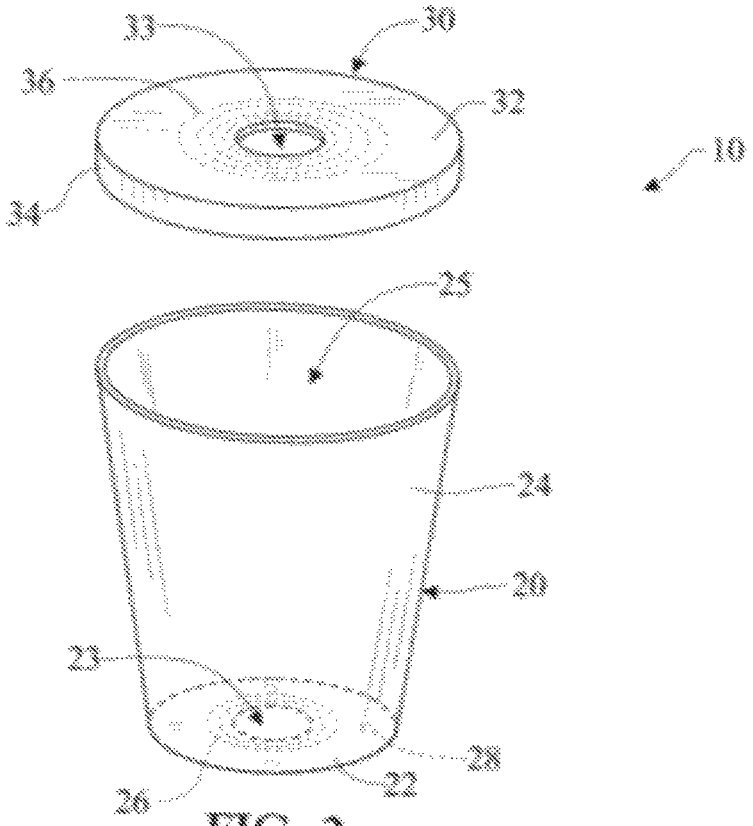
FIG. 2 presents an isometric exploded view of the sprinkler assembly protector of FIG. 1.

Referring initially to FIGS. 1 and 2, a sprinkler assembly protector 10 is illustrated in accordance with an exemplary embodiment of the present invention. As shown, the sprinkler assembly protector 10 includes a receptacle 20 for receiving a sprinkler assembly therein and a lid 30 for covering the receptacle 20. The sprinkler assembly protector 10 can be inserted into the ground and installed around a buried or partially buried sprinkler assembly to protect the sprinkler assembly from dirt, root damage, and other harsh environmental conditions.

The receptacle 20 of the present embodiment, as shown, has an inverted frustoconical shape which can facilitate the insertion of the receptacle into the ground. However, the receptacle 20 is not limited to this particular shape; rather, it can be of any other shape including cylindrical, rectangular, square, polygonal, tapered, straight shapes, etc. The receptacle is made in a single piece to avoid introducing cracks and other extraneous openings in the sidewall through which water, roots, insects, and the like may invade the receptacle 20.

The receptacle 20 includes a base 22 and sidewalls 24. The sidewalls 24 extend from the base 22, an internal space 25 thus being delimited by the base 22 and sidewalls 24. The base 22 includes a base opening 23 for a sprinkler assembly to pass through into the internal space 25 of the receptacle 20. In some embodiments, the internal space 25 may be configured to receive an additional sprinkler assembly to provide convenience for a user replacing a malfunctioning sprinkler assembly.

In addition, the base 22 can include tearing-facilitating sections 26 arranged around part of the perimeter of the base opening 23, or around the entire perimeter of the base opening 23. The tearing-facilitating sections 26 facilitate enlarging the base opening 23 and adjusting the sprinkler assembly protector 10 to fit onto sprinkler assemblies and/or water supply lines having different sizes. The tearing-facilitating sections 26 can be formed by, for example, perforated lines or thinner-walled lines (lines having a thinner cross-section than the rest of the receptacle base 22). The tearing-facilitating sections 26 of the present embodiment are shaped and arranged as concentric rings, which in turn are concentric to the base opening 23 so that the base opening 23 can be enlarged to several different sizes. In certain embodiments, the tearing-facilitating sections 26 can be tearing-facilitating lines extending radially on the base 22 so that the size of the base opening 23 can be gradually enlarged. Combinations of radial and concentric ring tearing-facilitating sections 26 are also contemplated.

The receptacle 20 can also include drainage holes for draining water that may accumulate inside the receptacle 20. It is contemplated that the drainage holes can be provided on the base 22 and/or the sidewalls 24 (normally, at the bottom portion of the sidewalls 24, proximate to the base 22). In an embodiment, four drainage holes 28 are formed on the base 22, although other numbers of drainage holes may be used. Further alternative embodiments are contemplated in which the drainage holes may present different shapes and/or sizes. Moreover, one or more punch out-facilitating areas may be provided in the base 20 or the bottom of the sidewalls 20, for example, an incised circle or other shape. In this embodiment, drainage holes need not be provided, as one or more such areas may be punched out to form them.

Similarly to the receptacle 20, the lid 30 of the present embodiment includes a top portion 32 and sidewalls 34. The lid 30 of the present embodiment is generally cylindrical. More generally, the lid top portion 32 is shaped and sized to cover the receptacle internal space 25. In turn, an inner face of the lid sidewalls 34 is shaped and sized in complementary resemblance with the upper edge of the receptacle sidewalls 24, in order for the lid 30 to snugly fit onto the receptacle 20.

The lid 30 further includes a lid opening 33 to allow a sprinkler assembly to pass through. A sprinkler assembly is therefore allowed to pass through the entire sprinkler assembly protector 10, i.e., through the base 22 (via the base opening 23), through the internal space 25, and through the lid 30 (via the lid opening 33).

In addition, the lid 30 can include tearing-facilitating sections 36 arranged around part of the perimeter of the lid opening 33, or around the entire perimeter of the lid opening 33; the tearing-facilitating sections 36 facilitate enlarging the lid opening 33 and adjusting the sprinkler assembly protector 10 to fit onto sprinkler assemblies having different sizes. The tearing-facilitating sections 36 can be formed by, for example, perforated lines or thinner-walled lines (lines having a thinner cross-section than the rest of the lid top portion 32). As shown, the tearing-facilitating sections 36 are in the shape of concentric rings, which in turn are concentric to the lid opening 33 so that the lid opening 33 can be enlarged to several different sizes. Alternatively, the tearing-facilitating sections 36 can be tearing-facilitating lines extending radially on the lid 30 so that the size of the lid opening 33 can be gradually enlarged.

The receptacle 20 and the lid 30 are preferably made of lightweight plastic materials such as, but not limited to, polyethylene terephthalate (PET), polyethylene (PE), high-density polyethylene (HOPE), low-density polyethylene (LOPE), polypropylene (PP), acrylonitrile butadiene styrene (ABS), or the like.

Figure 3:
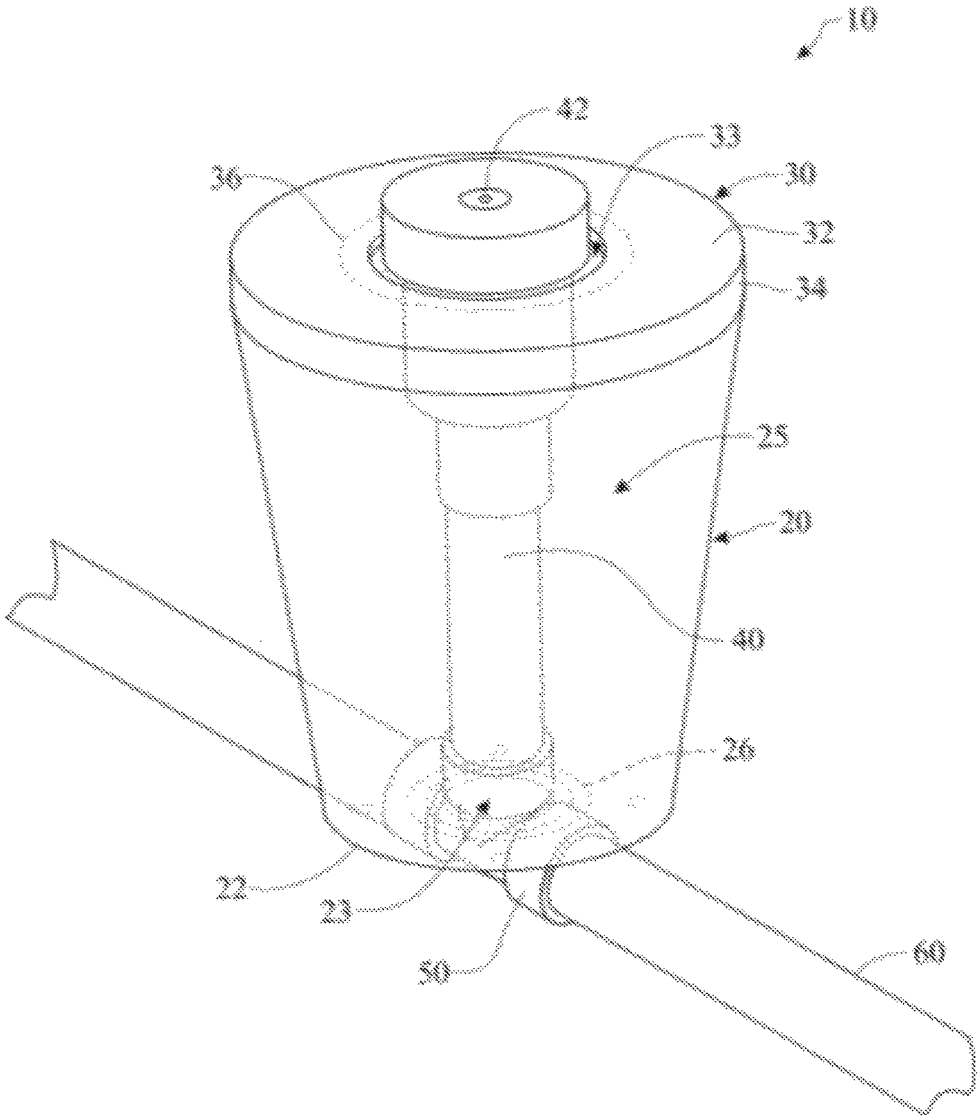
FIG. 3 presents an isometric view of the sprinkler assembly protector of FIG. 1, shown installed around a sprinkler assembly and resting on a T-shaped pipe connector outside of the receptacle, connected to the sprinkler assembly and a water pipe.

Referring now to FIG. 3, the sprinkler assembly protector 10 in accordance with an exemplary embodiment of the present invention is illustrated as being installed around a sprinkler assembly 40 and resting on a T-shaped pipe connector 50 connecting the sprinkler assembly 40 to water hose or pipe 60. As shown, the sprinkler assembly 40 passes through the base opening 23 of the receptacle 20 into the internal space 25 of the receptacle 20 so as to be protected from dirt and root damage. The top portion of the sprinkler assembly 40, where the sprinkler spout 42 is located, can pass through the lid opening 33 so as to facilitate the spraying of water. In order to install the sprinkler assembly protector 10 on this particular sprinkler assembly 40, the user has had to carry out the simple step of manually tearing the two innermost tearing-facilitating sections 26 of the lid top portion 32 in order to enlarge the lid opening 33 to fit the sprinkler assembly 40 therethrough; the present sprinkler assembly 40 has not required the user to make any adjustments to the base 22. In some embodiments, the internal space 25 may be configured to receive one or more additional sprinkler assemblies 40 to provide convenience for a user replacing a malfunctioning sprinkler assembly 40. It is to be understood that the sprinkler assembly 40 described herein may include various sub-assemblies or parts known in the art, such as a sprinkler body or a sprinkler riser.

Figure 4:
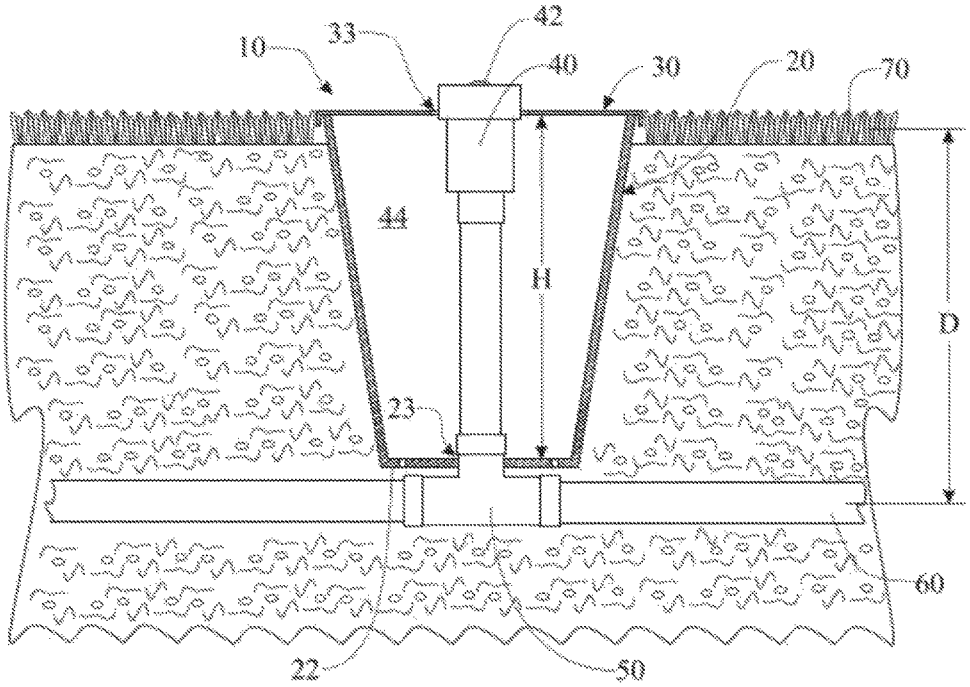
FIG. 4 presents a cross-sectional front elevation view of the assembly of FIG. 3, shown in a situation in which the sprinkler system is idle.

Referring now to FIG. 4, the sprinkler• assembly protector 10, sprinkler assembly 40, T-shaped pipe connector 50 and pipe 60 are depicted in a first situation in which the sprinkler system is idle. As shown, when installing the sprinkler system, the height H of the sprinkler assembly protector 10 is selected depending on, and more particularly, slightly less than, the depth D of the T-shaped pipe connector 50 being buried underground. In consequence, when the sprinkler assembly protector 10 is inserted into the ground, the sprinkler assembly protector 10 can rest on the T-shaped pipe connector 50 with the top of the lid 30 being generally even with the ground level 70. In this way, the sprinkler assembly protector 10 would not be damaged by lawnmowers or other machinery running on the ground. The sprinkler assembly 40 passes through the base opening 23 of the receptacle 20 to connect to the T-shaped pipe connector 50. The top portion of the sprinkler assembly 40 passes through the lid opening 33 so that the sprinkler spout 42 is exposed to the outside to facilitate the spraying of water.

Figure 5:
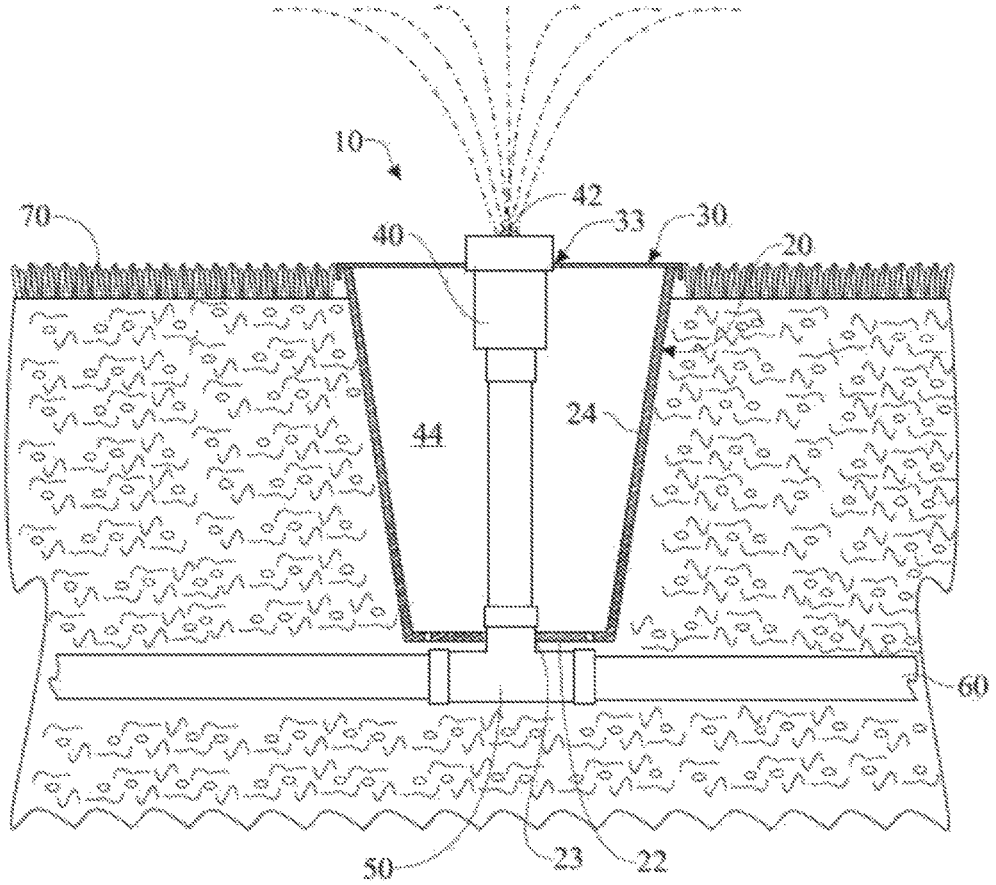
FIG. 5 presents a cross-sectional front elevation view of the assembly of FIG. 3, shown in a situation in which the sprinkler system is in operation.

The illustration of FIG. 5 shows the installation of FIG. 4 in operation, water being sprayed out of the sprinkler spout 42. As can be seen, the sprinkler assembly protector 10 does not interfere with the sprinkler assembly 40, and thus allows for normal and ready use of the sprinkler assembly 40 for watering purposes.

Preferably, the sprinkler assembly protector 10 is shaped and sized in order to leave a gap or clearance 44 between the sprinkler assembly 40 and the receptacle sidewalls 24 once the sprinkler assembly protector 10 is fitted onto the sprinkler assembly 40. Preferably, the clearance 44 is large enough for a person to insert one or both hands, or to insert an additional replacement sprinkler assembly 40 which a user may use to replace a malfunctioning sprinkler assembly 40. Such clearance facilitates maintenance, repair or replacement of the sprinkler assembly 40 without requiring removal of the sprinkler assembly protector 10.

Figure 6:
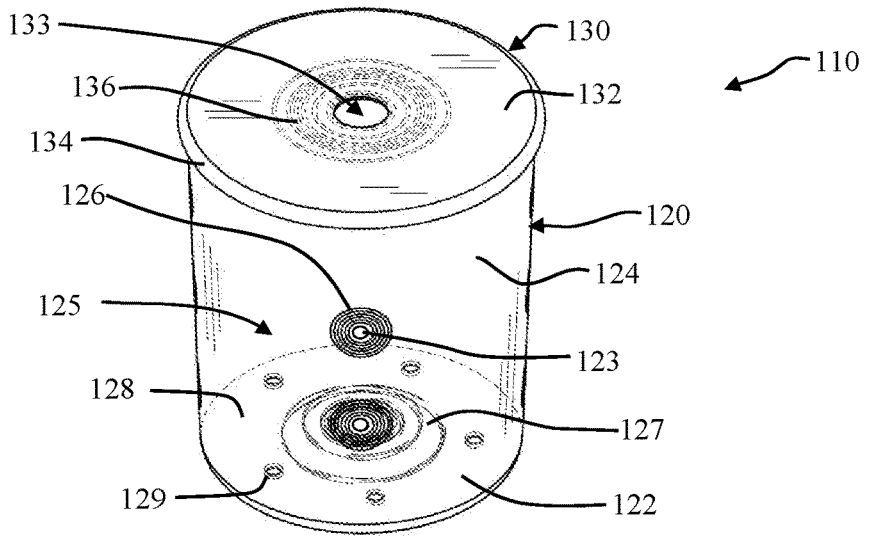
FIG. 6 presents an isometric view of a sprinkler assembly protector according to an exemplary embodiment of the present invention, shown assembled.
Figure 7:
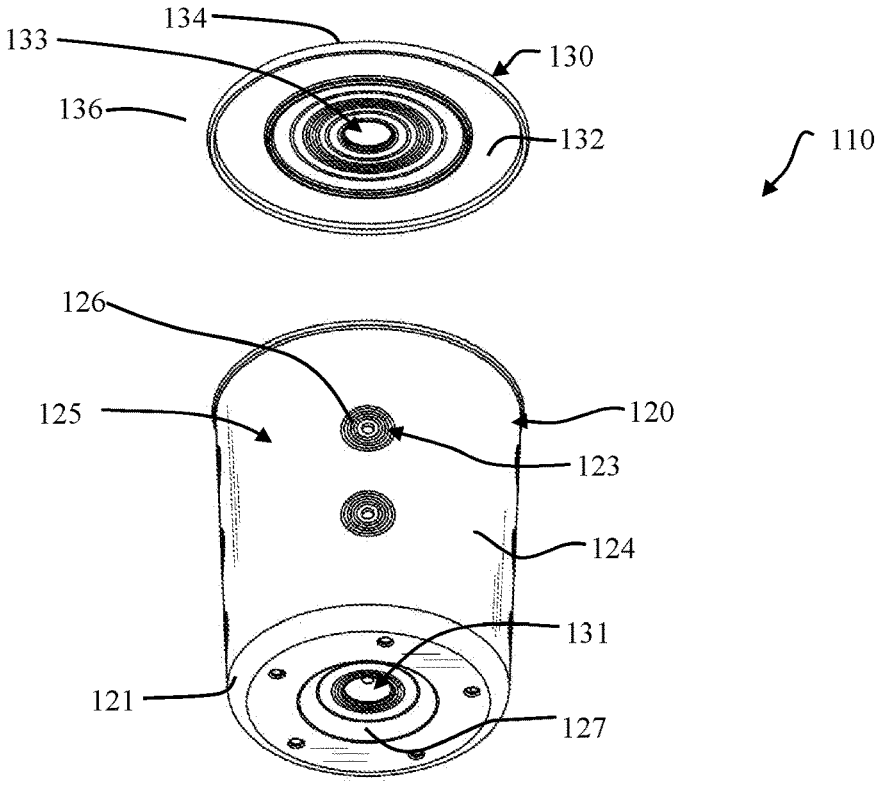
FIG. 7 presents an isometric exploded view of the sprinkler assembly protector of FIG. 6.

In FIGS. 6 through 10, aspects of another exemplary embodiment of sprinkler assembly protector is illustrated. As shown in FIGS. 6 and 7, the sprinkler assembly protector 110 includes a receptacle 120 for receiving a sprinkler assembly therein and a lid 130 for covering the receptacle 120. As before, the sprinkler assembly protector 110 can be inserted into the ground and installed around a buried or partially buried sprinkler assembly to protect the sprinkler assembly from dirt, root damage, and other harsh environmental conditions.

The receptacle 120 of the present embodiment, as shown, has a right circular conical shape, although other shapes may be used. The receptacle 120 includes a base 122 and sidewalls 124. The sidewalls 124 extend from the base 122, an internal space 125 thus being delimited by the base 122 and sidewalls 124. In embodiments, the internal space 125 may be configured to receive an additional sprinkler assembly to provide convenient storage for a user replacing a malfunctioning sprinkler assembly.

In contrast to the embodiments described above, alternatively to or in addition to the tearing-facilitating section on the bottom of the receptacle, the sidewalls 124 include one or more tearing-facilitating sections 126 surrounding sidewall holes or punch outs 123 for a sprinkler assembly water line to pass through into the internal space 125 of the receptacle 120. Preferably a plurality of tearing-facilitating sections 126 with holes or punch outs 123 are provided at a variety of heights and angular positions around a central axis of the receptacle 120. The tearing-facilitating sections 126 facilitate making and enlarging one or more sidewall openings 126 to accommodate water supply line inflow and outflow, and adjusting the sprinkler assembly protector 110 to fit onto sprinkler assemblies supply lines having different sizes. The tearing-facilitating sections 126 can be formed by, for example, perforated lines or thinner-walled lines (inscribed lines having a thinner cross-section than the rest of the receptacle sidewalls 124). The tearing-facilitating sections 126 of the present embodiment are shaped and arranged as concentric rings, which in turn are concentric to the sidewall opening or punch out 123 so that the sidewall opening 123 can be enlarged to several different sizes. In certain embodiments, the tearing-facilitating sections 126 can be tearing-facilitating lines extending radially on the sidewall 124 so that the size of the sidewall opening 123 can be gradually enlarged. Combinations of radial and concentric ring tearing-facilitating sections 126 are also contemplated.

The receptacle 120 can also include drainage holes 129 for draining water that may accumulate inside the receptacle 120. As shown, five drainage holes 129 are provided on the base 122, although it is contemplated that drainage holes may additionally or alternatively be provided on the sidewalls 124 (normally, at the bottom portion of the sidewalls 124, proximate to the base 122), and that other numbers or positions of drainage holes may be used, and/or may present different shapes and/or sizes.

In addition, a raised central area 131 of the base 122 is provided to direct any water that may enter the receptacle to the periphery of the base to facilitate drainage. As shown, the raised portion consists of a flat circular area atop a short frustoconical plinth 127. However, other shapes may be alternatively be used, such as a dome-shaped raised central area 131.

The lid 130 of the present embodiment includes a top portion 132 and sidewalls 134. The lid 130 of the present embodiment is generally cylindrical. The lid top portion 132 is shaped and sized to cover the receptacle internal space 125. In turn, an inner face of the lid sidewalls 134 is shaped and sized in complementary resemblance with the upper edge of the receptacle sidewalls 124, in order for the lid 130 to snugly and securely fit onto the receptacle 120.

The lid 130 further includes a lid opening 133 to allow a sprinkler assembly to pass through. A sprinkler assembly is therefore allowed to pass through the sprinkler assembly protector 110 through the sidewall 124 (via one or more opened sidewall punch outs 123 and tearing-facilitating sections 126), through the internal space 125, and through the lid 130 (via the lid opening 133).

In addition, the lid 130 can include tearing-facilitating sections 136 arranged around part of the perimeter of the lid opening 133, or around the entire perimeter of the lid opening 133; the tearing-facilitating sections 136 facilitate enlarging the lid opening 133 and adjusting the sprinkler assembly protector 110 to fit onto sprinkler assemblies having different sizes. The tearing-facilitating sections 136 can be formed by, for example, perforated lines or thinner-walled lines (scored lines having a thinner cross-section than the rest of the lid top portion 132). As shown, the tearing-facilitating sections 136 are in the shape of concentric rings, which in turn are concentric to the lid opening 133 so that the lid opening 133 can be enlarged to several different sizes. Alternatively, the tearing-facilitating sections 136 can be tearing-facilitating lines extending radially on the lid 130 so that the size of the lid opening 133 can be gradually enlarged.

Figure 8:
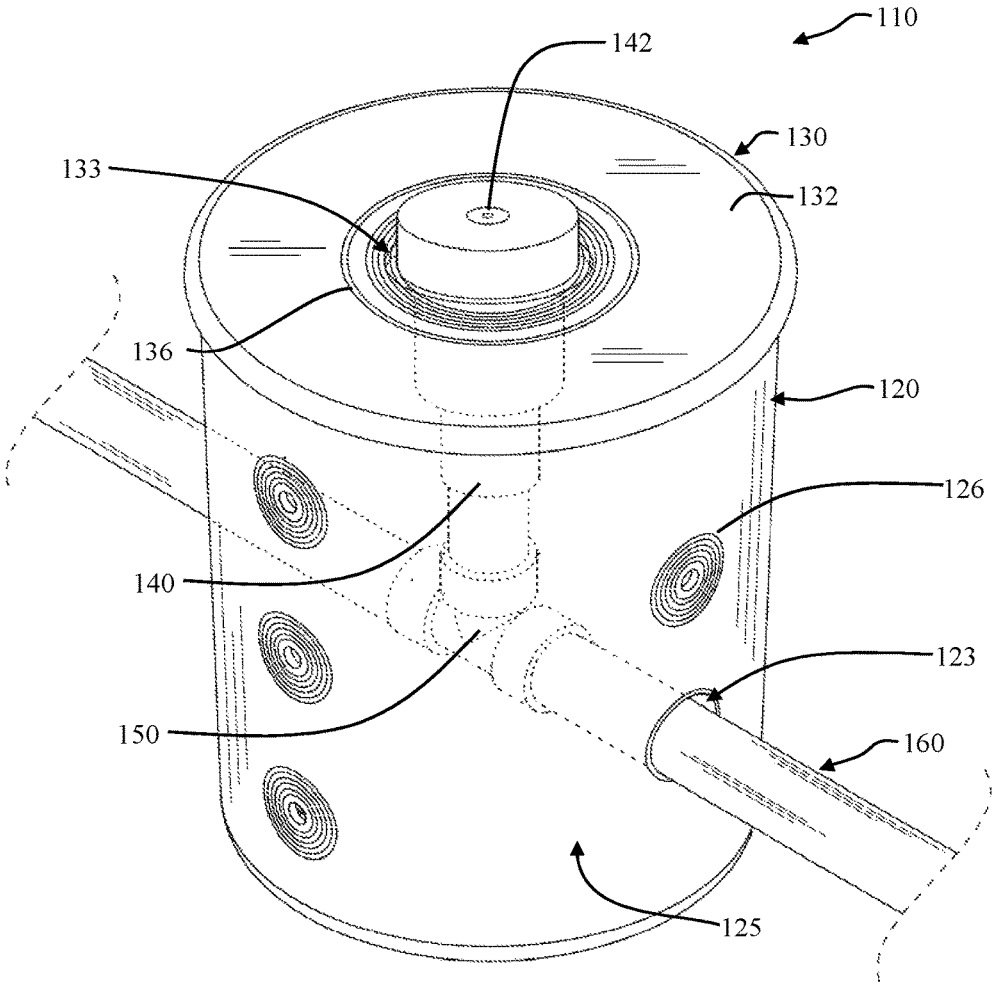
FIG. 8 presents an isometric view of the sprinkler assembly protector of FIG. 6, shown installed around a sprinkler assembly and encasing a T-shaped pipe connector connected to the sprinkler assembly and a water pipe.
Figure 9:
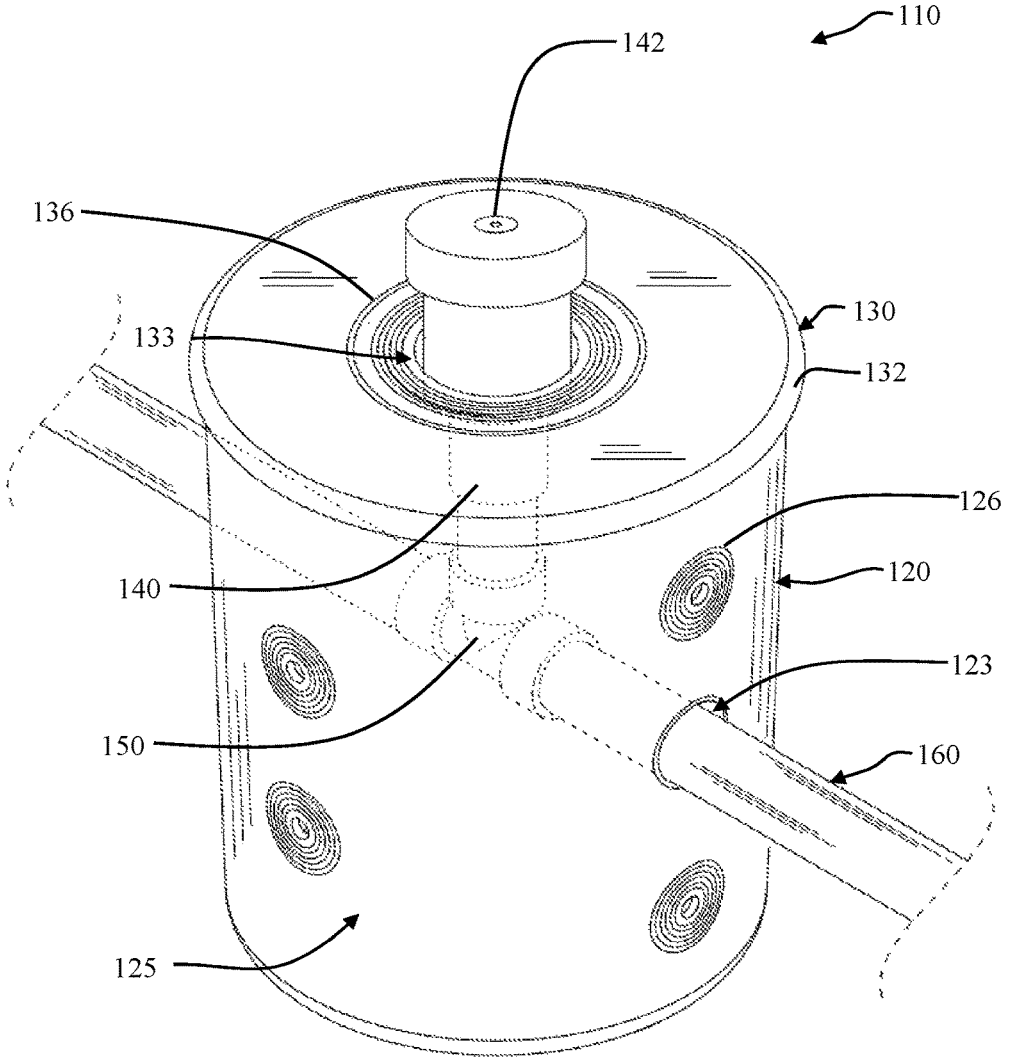
FIG. 9 presents an isometric view of the sprinkler assembly protector of FIG. 6, shown installed around a sprinkler assembly using different sidewall tearing-facilitating sections and encasing a T-shaped pipe connector connected to the sprinkler assembly and a water pipe.

Referring now to FIGS. 8 and 9, the sprinkler assembly protector 110 in accordance with an exemplary embodiment of the present invention is illustrated as being installed around a sprinkler assembly 140 and encompasses a T-shaped pipe connector 150 connecting the sprinkler assembly 140 to water hose or pipe 160. As shown, the sprinkler water feed line 160 passes through the sidewall openings 123 of the receptacle 120 into the internal space 125 of the receptacle 120 so as to be protected from dirt and root damage. The top portion of the sprinkler assembly 140, where the sprinkler spout 142 is located, can pass through the lid opening 133 so as to facilitate the spraying of water. In order to install the sprinkler assembly protector 110 on this particular sprinkler assembly 140, the user has had to carry out the simple step of manually tearing appropriate tearing-facilitating sections 136 of the lid top portion in order to enlarge the lid opening 133 to enable the sprinkler assembly 140 to pass therethrough.

Likewise, the user has had to manually tear appropriate tearing-facilitating sections 126 of the sidewalls to allow the water inflow and outflow lines to pass through the sidewall 120 into internal space 125. The tearing-facilitating sections on the sidewall are illustrated as comprising two dissimilar configurations disposed from each other at an angle of 90 degrees around a central axis of the receptacle 120. One configuration comprises three such sections in a set between the bottom and top of the sprinkler assembly protector 110, placed in a vertical line at ¼, ½, and ¾ of the distance from the bottom to the top. The other illustrated configuration comprises two tearing-facilitating sections in a set between the bottom and top of the sprinkler assembly protector 110, placed in a vertical line at ⅓ and ⅔ of the distance from the bottom to the top. Similarly, a 3-section set (not shown) is disposed on the opposite side of the sprinkler assembly protector 110 from the illustrated 3-section set, and another 2-section set (not shown) is disposed on the opposite side of the sprinkler assembly protector 110 from the illustrated 2-section set. In the installed embodiment illustrated in FIG. 8, the water line passes through a diameter of receptacle 120 at ⅓ of the distance from the bottom to the top of the sprinkler assembly protector 110. In contrast, in the installed embodiment illustrated in FIG. 9, the water line passes through a diameter of receptacle 120 at ½ of the distance from the bottom to the top of the sprinkler assembly protector 110, that is, slightly higher than in FIG. 8. Assuming the sprinkler assembly protector 110 is buried at the same depth in both installations, the sprinkler assembly 140 and sprinkler spout 142 is shown in FIG. 9 to extend higher than in FIG. 8. Thus, the embodiment illustrated in FIGS. 8 and 9 can accommodate a water line passing straight through a diameter of the receptacle 120, at any of five different heights from the bottom to the top of the sprinkler assembly protector 110.

Other arrangements are also contemplated that comprise different numbers of tearing-facilitating portions per set, and sets disposed at different heights and angular distances. For example, embodiments are contemplated in which all sets of tear-facilitating sections 126 are the same, and the sets are located at angular separations of 90 degrees, and/or angular separations greater and/or less than 90 degrees. Thereby, the water line inflow and outflow may point in different directions, for example at an outside right-angle corner of an installed lattice of sprinkler heads, or in a sprinkler installation in an area that contains acute and/or obtuse angles.

In some embodiments, the internal space 125 may be configured to receive one or more additional sprinkler assemblies 140 to provide convenience for a user replacing a malfunctioning sprinkler assembly 140. It is to be understood that the sprinkler assembly 140 described herein may include various sub-assemblies or parts known in the art, such as a sprinkler body or a sprinkler riser.

Figure 10:
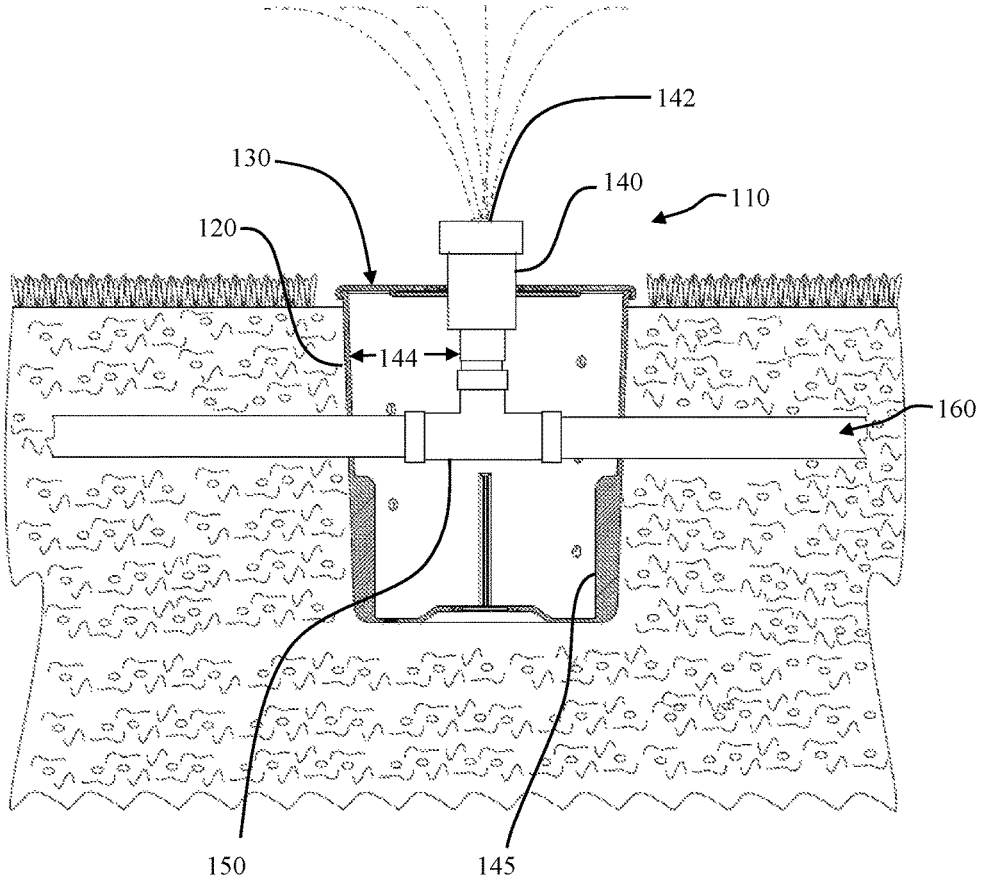
FIG. 10 presents a cross-sectional front elevation view of the assembly of FIG. 9, shown in a situation in which the sprinkler system is in operation.

Referring now to FIG. 10, the sprinkler• assembly protector 110, sprinkler assembly 140, T-shaped pipe connector 150 and pipe 160 are depicted in a situation in which the sprinkler system is in use. As shown, the sprinkler system has been installed with the top of the sprinkler assembly protector lid 130 being generally even with the ground level. Therefore, the sprinkler assembly protector 110 and the sprinkler assembly 140 should not be damaged by lawnmowers or other machinery running on the ground. The water line 160 passes through openings in sidewall 120 to connect to the T-shaped pipe connector 150. The top portion of the sprinkler assembly 140 passes through the opening in lid 130 so that the sprinkler spout 142 is exposed to the outside to facilitate the spraying of water. In addition, reinforcing ribs 145 have been included in this embodiment to provide added strength to sidewall 120.

Preferably, the sprinkler assembly protector 110 is shaped and sized in order to leave a clearance 144 between the sprinkler assembly 140 and the receptacle sidewalls 120 once the sprinkler assembly protector 110 is fitted onto the sprinkler assembly 140. Preferably, the clearance 144 is large enough for a person to insert one or both hands, or to insert an additional replacement sprinkler assembly 140 which a user may use to replace a malfunctioning sprinkler assembly 140. Such clearance facilitates maintenance, repair or replacement of the sprinkler assembly 140 without requiring removal of the sprinkler assembly protector 110.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A sprinkler assembly protector, comprising: a receptacle for receiving a sprinkler assembly therein, the receptacle including: a base and a tubular sidewall defining an internal space formed by the base and sidewall, the base having a central raised area, and the sidewall having: a first plurality of sidewall punch outs for making holes in the sidewall positioned in vertical alignment at a first end of the sidewall, a second plurality of sidewall punch outs for making holes in the sidewall positioned in vertical alignment at a second end opposite to the first end of the sidewall, each of the second plurality of sidewall punch outs being positioned at an equal height to one of first plurality of sidewall punch outs, a third plurality of sidewall punch outs for making holes in the sidewall positioned in vertical alignment at a third end of the sidewall, a fourth plurality of sidewall punch outs for making small holes in the sidewall positioned in vertical alignment at a fourth end opposite to the third end of the sidewall, wherein an axis crossing the first and second ends is orthogonal to an axis crossing the third and fourth ends, wherein each of the first and second plurality of sidewall punch outs have concentric tearing-facilitating sections for enlarging the holes to allow a water supply line to pass through the first end of the sidewall into the internal space and through the second end of the sidewall, wherein each the third and fourth plurality of sidewall punch outs have concentric tearing-facilitating sections for enlarging the holes to allow a water supply line to pass through the third end of the sidewall into the internal space and through the fourth end of the sidewall, and wherein each of the concentric tearing-facilitating sections is removable so as to enlarge the holes in the sidewalls to one of a plurality of sizes to accommodate different sizes for water supply lines;

a base opening provided within the central raised area, the base opening comprising punch outs having concentric tearing-facilitating sections for enlarging the opening to allow a water supply line to pass through the opening, the concentric tearing-facilitating section being removable so as to enlarge the base opening to one of a plurality of sizes and accommodate different sizes for water supply lines; drainage holes formed on the base and positioned radially outward of the central raised area of the base opening, and wherein the receptacle is sized to leave enough clearance to fit a replacement sprinkler between the sprinkler assembly and the sidewall; and a lid for covering the receptacle, the lid having a lid opening for allowing the sprinkler assembly to pass through, wherein the lid comprises concentric tearing-facilitating sections to facilitate enlarging the lid opening to one of a plurality of sizes so as to accommodate sprinkler heads of different sizes.

2. The sprinkler assembly protector of claim 1, wherein the tearing-facilitating sections on the sidewall are formed by perforated lines or thinner-walled scored lines.

3. The sprinkler assembly protector of claim 1, wherein the tearing-facilitating sections on the lid are perforated lines or thinner-walled scored lines.

* * * * *